United States Patent [19]

Ballard

[11] Patent Number: 4,834,186

[45] Date of Patent: May 30, 1989

[54] SPRINKLER HEAD MOUNTING SYSTEM

[76] Inventor: Estus E. Ballard, 6625 E. Calle Rendodo, Scottsdale, Ariz. 85251

[21] Appl. No.: 110,351

[22] Filed: Oct. 19, 1987

[51] Int. Cl.[4] ..... A62C 35/00

[52] U.S. Cl. ..... 169/16; 24/268; 169/37; 239/209; 248/57; 248/59; 248/74.1

[58] Field of Search ..... 169/51, 16, 17, 37; 239/208, 209; 24/268; 285/64; 52/39, 221, 484; 403/190, 191, 195, 397; 248/57, 59, 62, 74.1, 74.2, 74.3, 327

[56] References Cited

U.S. PATENT DOCUMENTS

| | | | |
|---|---|---|---|
| 796,178 | 8/1905 | Beaton | 248/57 |
| 833,613 | 10/1906 | Maiser | 248/57 |
| 844,977 | 2/1907 | Van Brunt | 248/74.1 |
| 949,576 | 2/1910 | Hunter | 248/57 |
| 2,474,062 | 6/1949 | Murphy | 24/268 |
| 2,627,635 | 2/1953 | Seltzer | 24/268 |
| 2,778,085 | 1/1957 | Bernard | 24/268 |
| 2,803,866 | 8/1957 | Flora | 24/268 |
| 4,563,795 | 1/1986 | Fournier | 24/268 |
| 4,669,911 | 6/1987 | Lundgren et al. | 24/268 |
| 4,717,099 | 1/1988 | Hubbard | 248/57 |

*Primary Examiner*—Sherman D. Basinger
*Assistant Examiner*—Thomas J. Brahan
*Attorney, Agent, or Firm*—Cahill, Sutton & Thomas

[57] ABSTRACT

A system for mounting a branch pipeline and sprinkler head assembly of a fire extinguisher sprinkler system to structural elements above the ceiling of a building in a manner which allows the sprinkler head to be vertically adjusted relative to the plane of the ceiling. The mounting system includes an anchor bracket which attaches the horizontal pipe of the branch pipeline to a structural element and a clamp which is attached to a structural element and is selectively operable for gripping and releasing the vertical pipe of the branch pipeline to allow vertical adjustment of the sprinkler head and hold it immobile subsequent to the vertical adjustment. The clamp is of special configuration which allows it to be operated in response to an operating force which is applied thereto in a direction parallel to the vertical pipe through a sprinkler head clearance hole formed in the ceiling.

5 Claims, 2 Drawing Sheets

SPRINKLER HEAD MOUNTING SYSTEM

BACKGROUND OF THE INVENTION

1. Field of the Invention

This invention relates in general to fire extinguisher sprinkler systems, and more particularly to a sprinkler head mounting system which allows adjustment of the sprinkler head relative to the ceiling through which the sprinkler head extends.

2. Description of the Prior Art

Automatic fire sprinkler systems have been used for many years in commercial and industrial establishments and in many areas, they are now being used in residential applications. There are several differences between residential sprinkler systems and those used in commercial and industrial applications. Among these differences are especially designed water spray patterns and increased operating speed which tests have shown as being necessary to control or extinguish fires in typical residences and to provide a greatly increased level of protection for human life.

In addition, considerable attention has been directed to the appearance of the sprinkler heads in order to make them aesthetically appealing to the homeowner or residential occupants. For this reason, the sprinkler heads are ideally mounted almost entirely within the ceiling and have only a relatively small portion of the sprinkler head depending from the ceiling into the room. Also, the escutcheons used are of relatively small plate-like configuration. Therefore, the sprinkler heads must be located much more precisely relative to the ceiling than is the case with commercial and industrial installations where appearance is of much less importance. Of course, the sprinkler head must not be excessively recessed relative to the plane of the ceiling lest the ceiling interfere with the desired water spray pattern. Likewise, the sprinkler head must not protrude excessively into the room or the desired aesthetic appearance will not be achieved. This poses some problems with an acceptable installation of residential sprinkler systems.

Sprinkler systems must be fully installed and pressure tested, with the system being inspected for leaks after a specific test period, and repaired if necessary. This can be a relatively simple task provided that it is done prior to installation of the ceiling and can be extremely difficult if it is accomplished subsequent to ceiling installation. For this reason, sprinkler systems are installed prior to installation of the ceiling and the plumber must make an educated guess as to just where the plane of the subsequently installed ceiling will be. Due to the non-precise nature of walls, ceilings and related construction, more often than not, the location of the sprinkler heads will not be located within the relatively small positioning constraints imposed upon residential system installations. Therefore, some vertical movement of the sprinkler heads will be required in many instances to properly locate the heads relative to a subsequently installed ceiling. Even after installation and sprinkler head repositioning has been accomplished, things can change, such as sagging of the ceiling, which requires further vertical repositioning or adjustment of the heads.

In situations where sprinkler head positioning deviates only slightly from the ideal location, a simple sliding movement of the escutcheon plate axially along the sprinkler head body may be all that is needed to achieve an aesthetically acceptable appearance. However, some types of sprinkler heads make no provisions for such adjustments, while in others this remedy is limited to small deviations of about $\frac{1}{4}$ inches or so.

In cases where sprinkler head positioning deviates more than a minimal amount, one prior art technique used, is to remove the sprinkler head and reinstall it with a longer nipple, shorter nipple, or otherwise modifying the installation as necessary to achieve whatever vertical repositioning is needed. This technique is very undesirable due to the costly labor and material involved.

In an attempt to overcome the above installation problem associated with residential sprinkler systems, an adjustable extensible nipple assembly has been devised. The special nipple includes an outer casing which is threadingly attached to the sprinkler piping system so as to be disposed in a vertical attitude. The depending end of the outer casing is internally threaded and an inner tube is carried in the bore of the outer casing for threaded axial adjustment relative to the outer casing. The upper end of the inner tube has a pair of O-ring gaskets which form a leakproof seal within the bore of the outer case, and the lower end of the inner tube is internally threaded for mounting of the sprinkler head therein. Although this prior art adjustably extensible nipple assembly solves the problem of vertical sprinkler head relocation to match the plane of a subsequently installed ceiling, there are two basic problems associated with this nipple. The first problem is that the adjustable nipples rely on the pair of O-rings to provide the leak-proof seal, and O-rings deteriorate with time.

The second problem associated with these adjustable nipples is the cost. As is known, sprinkler systems are subject to rather stringent regulations, must be able to withstand high water pressure, water hammer and the like for indefinite periods of time, and then must be workable when and if needed. For these reasons, these adjustable nipples are precision devices which have undergone extensive testing and the like, and as a consequence are very expensive.

Therefore, a need exists for a new and improved sprinkler head mounting system which overcomes some of the problems and shortcomings of the prior art.

SUMMARY OF THE INVENTION

In accordance with the present invention, a new and improved sprinkler head mounting system is disclosed which allows installed sprinkler heads to be vertically moved into a proper position relative to a subsequently installed ceiling.

As is well known sprinkler systems per se generally include a main, or trunk, pipeline which is connected to a suitable source of water under pressure, such as a municipal water supply, and a plurality of branch pipelines which extend from the trunk. Each branch pipeline includes a horizontal portion which extends from the trunk pipeline to the location of the sprinkler head and a vertical portion which extends downwardly from the distal ends of the horizontal portion to a position proximate the plane of the ceiling. The sprinkler head is mounted on the depending end of vertical portion of the branch pipeline by means of suitable fittings.

In accordance with the present invention, the sprinkler head mounting system includes an anchor means which is attached to the horizontal portion of the branch pipeline for anchoring the horizontal portion thereof to a structural component of the building which, in most if not all cases will be a ceiling joist. The anchor means is set back from the junction of the horizontal and vertical portions of the branch pipeline a distance which allows the distal end of the horizontal portion and the vertical portion carried thereby, to be moved vertically. In otherwords, the anchor means serves as a fulcrum about which the downstream portion of the branch pipeline and the sprinkler head are flexibly movable, with the anchor means serving to insulate such movements from the trunk pipeline and similarly, to prevent movements, vibrations and the like, of the trunk pipeline from being transmitted to the downstream portions of the branch pipeline and, of course, the sprinkler head carried thereby. In addition to the anchor means, the system of the present invention further includes a special clamp means which is fixedly mounted to a structural component of the building, again most likely a ceiling joist, so that the clamp means can be selectively operated to clampingly engage the vertical portion of the branch pipeline against vertical movement or release it to permit such vertical movement. The clamp means is special in that it is configured for operation between a clamped position and a released position in response to an operating force applied thereto in a direction which is parallel with respect to the axis of the vertical portion of the branch pipeline. This capability allows the clamp means to be operated between its clamped and released positions from below the ceiling by insertion of a suitable tool through the clearance hole provided in the ceiling for the sprinkler head.

The anchor means may be in the form of any suitably configured bracket which can be fixedly attached to the ceiling joist such as by nails or other suitable fasteners. Also, the anchor means is intended to be fixedly attached to the branch pipeline such as by being soldered to metallic pipe, cemented to plastic pipe, and, of course the bracket would need to be fabricated of a material which would allow such fastening. Alternatively, suitable mechanical fasteners may be used to fixedly attach the anchor means to the branch pipeline.

In a first embodiment, the axially operable clamp means is of substantially U-shaped configuration having a bight portion which is attached to the ceiling joist, or other structural element of the building. A pair of spring arms extend from the top and bottom ends of the bight portion with each arm having an opening formed therethrough. The spring arms are normally biased away from each other so that the openings formed therethrough will be out of axial alignment with each other. Therefore, when the arms are moved out of their normal positions toward each other, to bring the openings thereof into alignment with each other, the vertical portion of the branch pipeline can be axially moved in the openings of the spring arms. When the arms are released, which allows them to move back toward their normal positions, the arms will move into frictional engagement with the vertical portion of the branch pipeline and thereby hold the pipeline in a fixed position relative to the clamp. The action required to move the spring arms toward each other, and thereby release the grip of the clamp on the vertical portion of the branch pipeline for vertical adjustment purposes, is accomplished in a direction which is parallel to the axis of the pipeline. Therefore, any suitable tool which can be inserted through the opening of the ceiling into engagement with the lower arm to push it toward the upper arm, or into engagement with the upper arm to pull it downwardly toward the lower arm, can be used to release the clamp or vertical adjustment of the sprinkler head relative to the ceiling.

In a second embodiment, the clamp means is configured similarly to the clamp means discussed above, except that the spring arms normally extend in parallel relationship with respect to each other so that the openings formed therethrough are in axial alignment with respect to each other. Thus, in the normal position of this clamp means, the vertical portion of the branch pipeline may be vertically adjusted relative to the clamp means. A fastener means in the preferred form of a screw an captive nut arrangement is mounted between the extending ends of the arms and is operable to pull the arms toward each other and thereby move them into frictional gripping engagement with the pipeline to hold it against vertical movement. Accordingly, a screw driver that is inserted through the sprinkler head opening of the ceiling is all that is needed to operate this embodiment of the clamp means of the present invention.

In a third embodiment of the present invention, the clamp means which is of low profile configuration that makes it ideal for use in limited space installations, is in the form of a band clamp having a mounting flange for attachment thereof to the ceiling joist. The opposite ends of the head clamp are turned outwardly so that they form lugs which are in spaced apart facing relationship with respect to each other. The lugs are in the form of frusto-conical segments with one of the lugs being further configured so as to carry a screw that is disposed to extend upwardly between the lugs. A draw member of downwardly opening frusto-conical configuration is carried on the upper end of the screw and is stradlingly disposed relative to the lugs of the band clamp. When the screw is operated to elevate the draw member so that it is out of engagement with the lugs of the band clamp, the vertical portion of the branch pipeline is free to be moved axially in the band clamp. Operation of the screw to move the draw member downwardly into engagement with the lugs of the clamp will move the lugs toward each other which circumferentially reduces the diameter of the clamp to bring it into gripping engagement with the pipeline.

It will be seen from the above, that the anchor means and clamp means of the sprinkler head mounting system of the present invention are attached to the sprinkler system as opposed to the prior art structure which is an integral part of the system. In that the anchor means and clamp means are not subjected to water pressure, and are not directly concerned with water flow or any other critical function of the sprinkler system, the stringent requirements imposed on the prior art structures do not apply to the structures of the present invention. Therefore, the costs for fabricating the anchor means and clamp means of the present invention are considerably less than the extensible nozzle of the prior art. Further, the present mounting system is simple to install, can be used with any sprinkler system and components, and provides a simple and effective way of vertically adjusting the sprinkler heads.

Accordingly, it is an object of the present invention to provide a new and improved sprinkler head mounting system, which is inexpensive to fabricate and is simple to install and use.

Another object of the present invention is to provide a new and improved sprinkler head mounting system which is operable to allow vertical adjustment of the sprinkler head relative to the plane of a ceiling structure.

Another object of the present invention is to provide a new and improved sprinkler head mounting system which includes an anchor means for fixed attachment to a horizontal portion of a branch pipeline which extends from a trunk pipeline to a sprinkler head so that forces applied to the trunk pipeline will be insulated against transmission to the sprinkler head and force applied to the sprinkler head will be insulated against transmission to the trunk pipeline.

Another object of the present invention is to provide a new and improved sprinkler head mounting system of the above described character which further includes a clamp means which is operable between holding and released engagement with the vertical portion of the branch pipeline for adjustable positioning of the sprinkler head carried on the lower end of the vertical portion of the branch pipeline relative to the plane of the ceiling through which the sprinkler head extends.

Still another object of the present invention is to provide a new and improved sprinkler head mounting system of the above described type wherein the clamp means is configured so that operation thereof is accomplished by application of an operating force in a direction which is parallel with the longitudinal axis of the vertical portion of the branch pipeline.

The foregoing and other objects of the present invention as well as the invention itself may be more fully understood from the following description when read in conjunction with the accompanying drawings.

DESCRIPTION OF THE PREFERRED EMBODIMENTS

Figure 1:
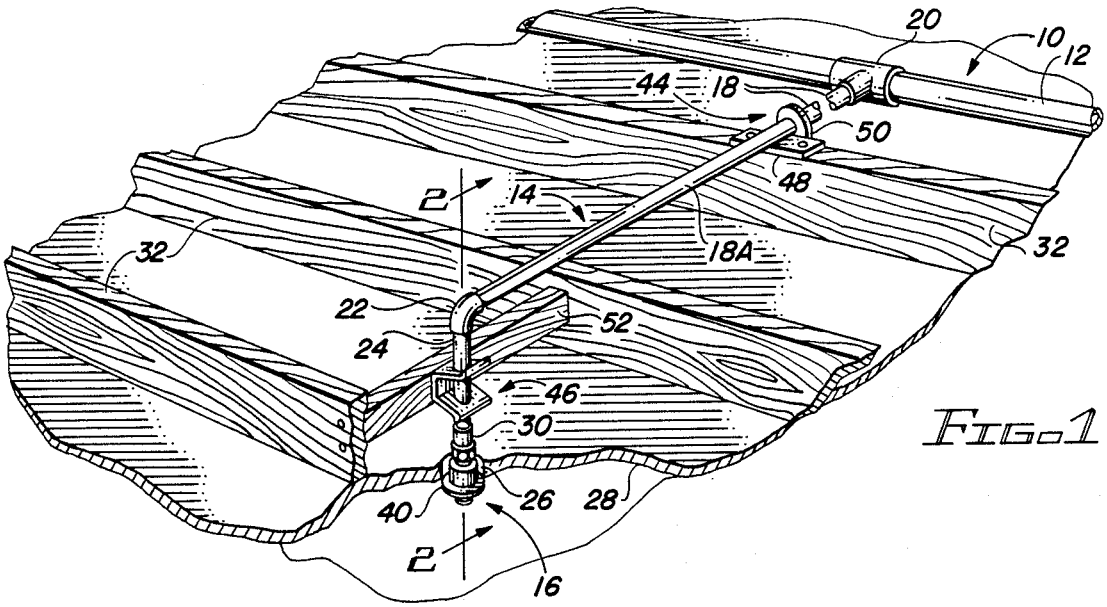
FIG. 1 is a fragmentary perspective view of a portion of a typical fire sprinkler system having the sprinkler head mounting system of the present invention installed thereon.

Referring more particularly to the drawings, FIG. 1 shows a fragmentary portion of a typical fire sprinkler system which is indicated generally by the reference numeral 10. As is known, a typical sprinkler system 10 will include a main, or trunk pipeline 12 which is connected to a suitable source of water under pressure (not shown) such as a municipal water supply. The sprinkler system 10 further includes a plurality of branch pipelines 14 (one shown) which extend laterally from the trunk pipeline 12 to the various locations where sprinkler heads 16 are to be located. The branch pipeline 14 includes a horizontal portion 18 one end of which is coupled to the trunk pipeline 12 such as by a tee-fitting 20. The distal end of the horizontal pipe 18 has an elbow 22 mounted thereon with a vertical portion 24 of the branch pipeline 14 depending therefrom into the vicinity of an opening 26 provided in a ceiling panel 8. The depending end of the vertical pipe 24 has a suitable fitting means 30, such as the illustrated adapter, and the sprinkler head assembly 16 is attached to the depending end of the vertical pipe 24 by means of the adapter 30. FIG. 1 also shows the usual ceiling joists 32 to which the ceiling panel 28 is attached as is customary.

Figure 2:
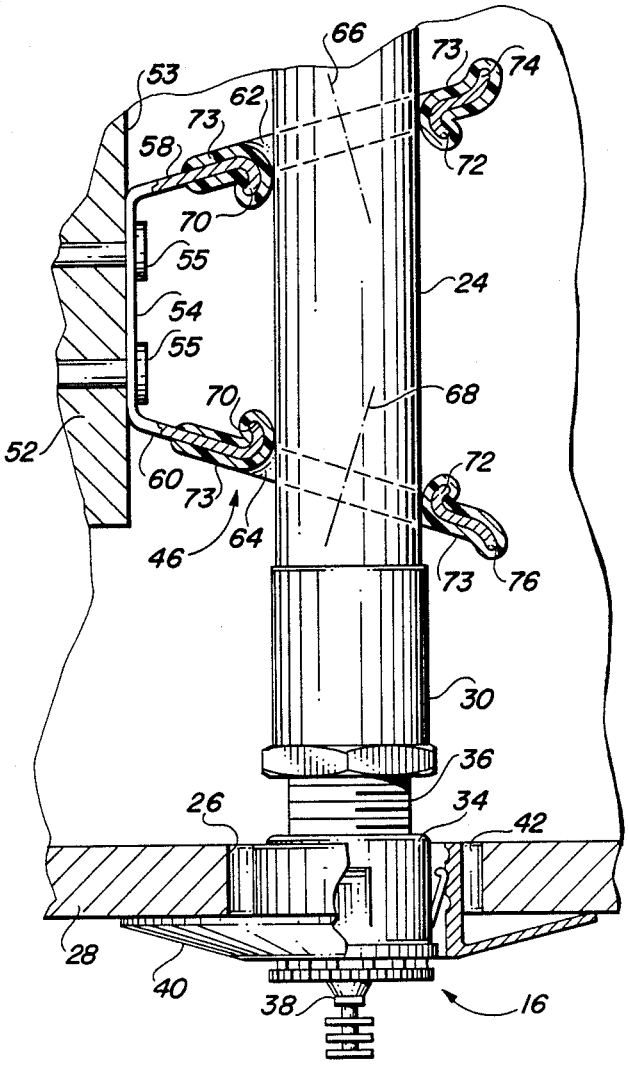
FIG. 2 is an enlarged fragmentary sectional view taken along the line 2—2 of FIG. 1 and showing the first embodiment of a clamp means in an engaged position relative to the vertical portion of a branch pipeline of the sprinkler system.

As seen best in FIG. 2, the sprinkler head assembly 16 includes a body 34 having an axially extending boss 36 which is threadingly attached to the adapter fitting 30, with the temperature sensitive sprinkler element 38 extending axially from the opposite end of the body 34. As shown, the opening 26 formed through the ceiling panel 28 is larger in diameter than the sprinkler head body 34 and an escutcheon plate 40, that is in frictional engagement with the sprinkler head body 34, is employed to cover the annular space 42 between the body 34 and peripheral diameter of the opening 26.

The sprinkler head mounting system of the present invention includes two major components with the first being an anchor means 44 and the second being a clamp means 46.

The anchor means 44, as shown in FIG. 1 is in the preferred formed of a bracket having a flange 48 which is nailed or otherwise attached to the top end of one of the ceiling joists 32, and a loop portion 50 which circumscribes the horizontal pipe 18 of the branch pipeline 14. As is well known, both plastic pipe, such as polyvinyl chloride (PVC), and metallic pipe, such as copper, are being used in sprinkler head installations. Therefore, it is preferred that the anchor means 44 be fabricated of a compatible material so that the anchor means 44 can be soldered to metallic pipe, or cemented to plastic pipe. In either case, it is preferred that the anchor means 44 be fixedly attached to the horizontal pipe 13 so that movements, vibrations and the like, of the trunk pipeline 12 will not be transmitted to those downstream portions of the branch pipeline which extend beyond the anchor means toward and including the sprinkler head 16. Also, as will hereinafter be described in detail, so that movements of the sprinkler head 16 will be isolated from the trunk pipeline 12.

As will become apparent from the following description the sprinkler head 16 and the vertical pipe 24 are vertically adjustable in order to bring the previously installed sprinkler head into conformity with a subsequently installed ceiling panel. In order to accomplish such vertical adjustment, the portion 18A of the horizontal pipe 18 which is downstream of the anchor means 44 must be capable of a flexing-like bending movement. Therefore, the anchor means 44 must be set back from the elbow 22 a sufficient distance to enable the desired flexing movement. It has been found that if the anchor means 44 is about a minimum of 18 inches from the elbow end of the horizontal pipe 18, sufficient flexure of the horizontal pipe portion 18A relative to the fulcrum provided by the anchor means 44 will be achieved.

As shown in FIG. 1, a suitable structural element such as the illustrated stringer 52 may be mounted so as to extend between an adjacent pair of the ceiling joists 32 to provide a fixed vertical surface 53 proximate the desired location of the vertical pipe 24 of the branch pipeline 14. If one of the ceiling joists 32 happens to be in the right location, it can be used to provide the fixed vertical surface. In either case, the clamp means 46 is attached to the vertical surface 53 in operative engagement with the vertical pipe 24.

In a first embodiment, the clamp means 46 is of generally U-shaped configuration having a bight portion 54 which is fixedly attached to the vertical surface 53 such as by nails 55 that are passed through the apertures 56 formed therein for that purpose. A pair of spring arms 58 and 60 extend integrally from the opposed top and bottom ends of the bight portion 54 and openings 62 and 64 are formed through the arms 58 and 60 respectively. The clamp 46 is fabricated of a suitable resilient material such as spring steel, and the spring arms are biased so that they normally extend from the bight portion 54 at a diverging angle with respect to each other. Therefore, in the normal positions of the spring arms 58 and 60, the axes 66 and 68 of the openings 62 and 64 are out of alignment with each other and out of alignment with the longitudinal axis of the vertical pipe 24 which passes through the openings 62 and 64. When the spring arms 58 and 60 are moved toward each other, as will hereinafter be described, the axes 66 and 68 of the opening 62 and 64 will, of course, be moved toward an inline relationship with the axis of the vertical pipe 24. This, in conjuction with the spring arm openings 62 and 64 being larger than the diameter of the vertical pipe 24, will allow the pipe 24 to be moved vertically through the openings of the spring arms. When the spring arms 58 and 60 are allowed to move back toward their normal positions, those portions of the arms which define the openings 62 and 64 will move into gripping engagement with the vertical pipe 24 as shown in FIG. 2.

Figure 3:
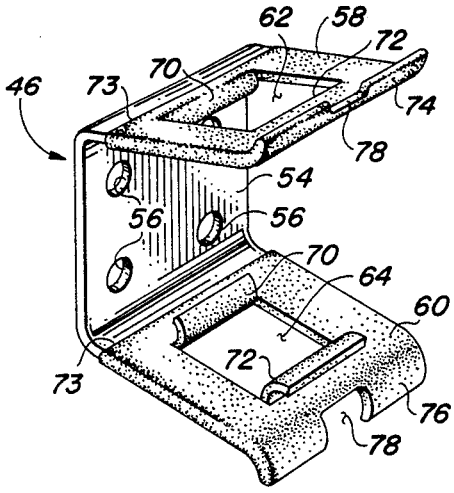
FIG. 3 is a perspective view of the clamp means shown in FIG. 2.

As seen best in FIG. 3, the openings 62 and 64 of the spring arms 58 and 60 are preferably of square configuration with the inner and outer pipe gripping edges of each opening 62 and 64 being folded away from the openings to form inwardly disposed curved flaps 70 and outwardly disposed curved flaps 72. The curved flaps 70 and 72 grippingly engage the diametrically opposed sides of the vertical pipe 24 and will not cut into the pipe as could happen in the absence of the curved flaps. The spring arms 58 and 60 are preferably coated as at 73 with a suitable dielectric material, such as vinyl to further cushion the gripping forces and to prevent electrolytic action between dissimilar metals when metallic pipe is used in fabrication the sprinkler system 10.

Figure 5:
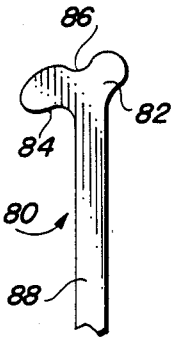
FIG. 5 is a fragmentary elevational view of a tool suitable for operation of the clamp means shown in FIGS. 1, 2, 3 and 4.

The extending ends 74 and 76 of the spring arms 58 and 60 respectfully, are curved away from each other with each of those curved extending ends having a central notch 78 formed therein. The notched and curved configuration of the extending ends 74 and 76 are provided to facilitate movement of the spring arms out of their normal pipe gripping positions toward each other into a released position, with such operating movement by necessity, being applied in a direction which is parallel with the longitudinal axis of the vertical pipe 24. In otherwords, vertical adjustment of the sprinkler head 16 relative to the subsequently installed ceiling panel 28 or one of which has sagged with time, is accomplished with the escutcheon plate 40 removed, and insertion of a suitable tool through the annular space 42 into engagement with either the top spring arm 58 to pull it down, or with the bottom spring arm 60 to push it up. A suitable tool 80 is shown in FIG. 5 as having a head 82 with a hook 84 for pulling down the top spring arm 58 and a notch 86 for pushing up the lower spring arm 60. Of course, this tool 80 has an elongated handle 88.

Figure 4:
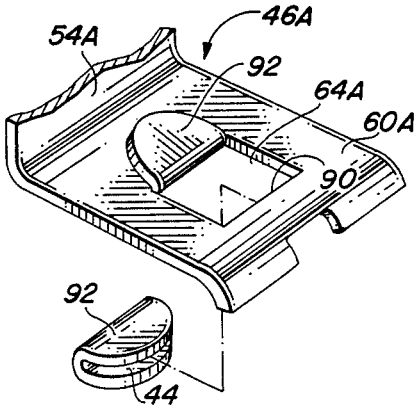
FIG. 4 is a fragmentary perspective view similar to FIG. 3 but showing a modification of the clamp means shown in FIGS. 2 and 3.

Reference is now made to FIG. 4., wherein a fragmentary view of a modified form of clamp means 46A is shown. The clamp means 46A is similar to the hereinbefore described clamp means 46 and therefore has a bight portion 54A with a pair of spring arms only one of which is shown at 60A in FIG. 4. The opening 64A formed in the spring arm 60A is square as in the above discussed clamp means 46, but does not have the curved flaps 70 and 72 or the coating 73. Instead, the opposed pipe gripping edges 90 (one shown) of the opening 64A are each covered with a demountable grommet 92 which serve both to prevent electrolytic action, and prevent damage to the vertical pipe 24 which could otherwise occur as a result of the pipe gripping edges 90. The grommets 92 may be formed of any suitable material such as rubber, neoprene or the like, and are of folded-over configuration to define a slot 94 for receiving the pipe gripping edge 90. Although the top arm of the modified clamp means 46A is not shown, it will be understood that it is similarly configured and equipped with identical grommets.

Figure 6:
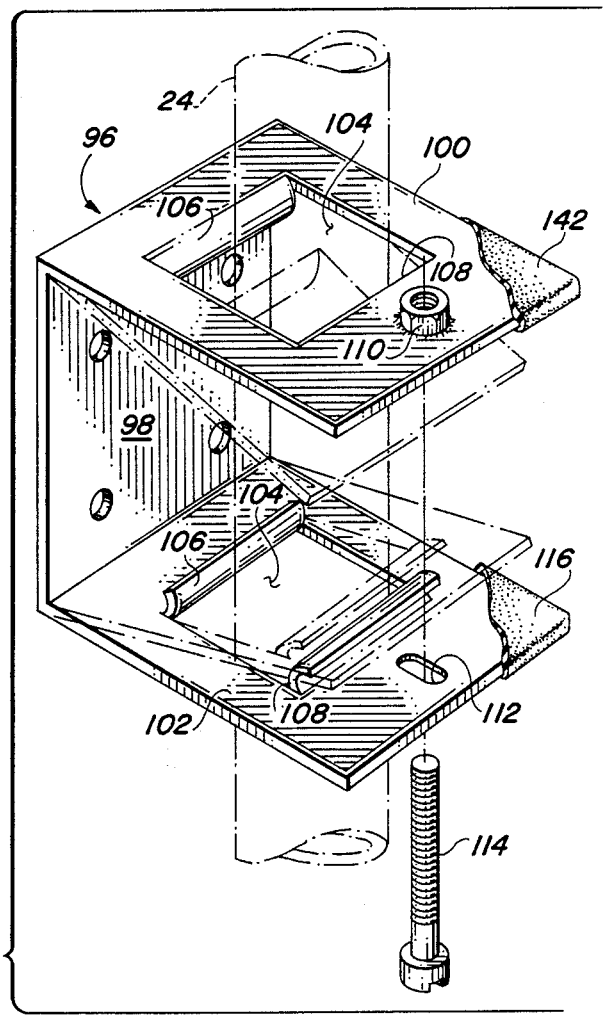
FIG. 6 is an exploded perspective view of a second embodiment of the clamp means.

A second embodiment of the clamp means is shown in FIG. 6 with this embodiment being indicated generally by the reference numeral 96. The clamp means 96 is similar to the clamp means 46 in that it is of U-shaped configuration having a bight portion 98 for attachment to a structural member such as the stringer 52 shown in FIGS. 1 and 2. A pair of spring arms 100 and 102 extend from the top and bottom ends of the bight portion 98, and are normally disposed in parallel relationship with respect to each other and extend perpendicularly from the bight portion 98. Each of the spring arms 100 and 102 have a square opening 104 formed therein through which the vertical pipe 24 passes. The arms 100 and 102 are formed in the same manner as the arms 58 and 60 of the clamp means 46 insofar as having curved flaps 106 and 108 which define the pipe gripping edges of the openings 104. However, the upper arm 100 has a suitable captive nut 110 welded or otherwise mounted thereon, and the lower arm 102 is provided with an oval aperture 112 which aligns with the captive nut 110. A screw fastener 114 is positioned so a to extend through the aperture 112 into threaded engagement with the captive nut 110.

When the spring arms 100 and 102 are in their normal positions, the vertical pipe 24 is free to be vertically moved through the aligned openings 104 of the arms, and rotation of the screw fastener 114 will move the arms toward each other as indicated in dashed lines in FIG. 6. Such movement of the arms 100 and 102 toward each other will move the curved flaps 106 and 108 into gripping engagement with the pipe 24 which, of course, holds the pipe against vertical movement relative to the clamp means 96. For the same reasons discussed above, the arms 100 and 102 are coated as at 116 with a suitable material such as vinyl.

Figure 7:
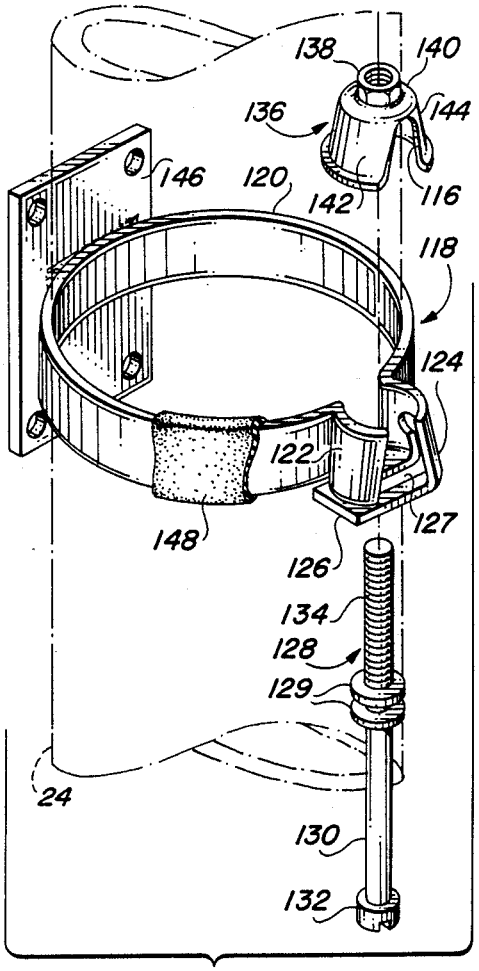
FIG. 7 is an exploded perspective view of a third embodiment of the clamp means.
Figure 8:
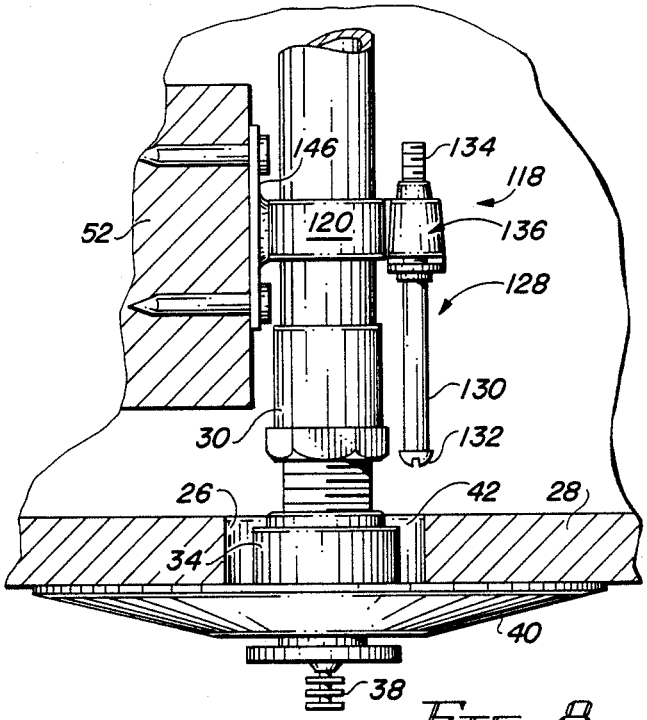
FIG. 8 is a fragmentary sectional view similar to FIG. 2 and showing the third embodiment of the clamp means in the installed position.

Reference is now made to FIGS. 7 and 8 wherein a third embodiment of clamp means is shown with this third embodiment being identified in its entirety by the reference numeral 118 the clamp means 118 includes a circular band 120 having adjacent ends that are bent outwardly to provide spaced apart cofacing ears 122 and 124. The circular band 120 is formed of a suitable resilient material such as spring steel so that the ears 122 and 124 are normally spaced apart as shown. The ears 122 and 124 are in the shape of frusto-conical segments so that when the ears are drawn together, as will hereinafter be described, to provide a pipe gripping position of the clamp means 96, the ears will move straight toward each other and thus not cause any twisting of the band 120. The ear 124 has a flange 126 which extends normally from its lower edge so as to pass under the lower edge of the other ear 122. The flange 126 serves as a bearing surface for the ear 122 to guide it in its movements toward the ear 124. Also, the flange 126 and the ear 124 are provided with a keyholeshaped aperture 127 for receiving a special fastener 128 which has an axially spaced apart pair of annular ribs 129 which are on opposite sides of the flange 126 for attaching the fastener to the flange in a manner which allows it to be rotated in the aperture 127. The fastener 128 has a depending shank portion 130 with a suitable head 132 which is disposed proximate the ceiling opening 26 when the clamp means 118 is installed as shown in FIG. 8 and a threaded shank 134 which extends upwardly between the ears 122 and 124. A draw member 136 is threadingly carried on the threaded shank of the fastener 128. The draw member 136 is configured in the shape of a downwardly opening saddle-like structure having a captive nut 138 its bight portion 140, and a pair of diametrically opposed arms 142 and 144 which divergingly extend from the bight portion 140 and are configured in the shape of frusto-conical segments. When the draw means 136 is mounted on the screw fastener 128 and the screw fastener is rotated, such as by means of a conventional screw driver (not shown), the draw means 136 will straddle the ears 122 and 124 respectively, and draw them toward each other. This action will tighten the clamp from its illustrated released position wherein the vertical pipe 24 is free to be vertically moved through the circular band 120, to a pipe holding position that prevents such movement.

The clamp means 118 further includes a mounting flange 146 which is welded or otherwise mounted fast with the circular band 120 at a location which is diametrically opposed with respect to the ears 122 and 124. Further, a suitable coating 148 of the type discussed above with reference to the clamp means 46, may be provided on the clamp means 118 to prevent electrolytic action.

It will be noted that each of the hereinbefore described clamp means 46, 46A, 96 and 118 are operable between released and pipe gripping positions and the forces required to operate the clamps are exerted in a direction which is parallel with the axis of the pipe being held. Therefore, as discussed above, suitable tools can be moved into proper operating engagement with the clamps from below the ceiling panels 28 via the annular spaces 42 provided around the sprinkler head bodies 34.

It will be appreciated that the clamp means 118 of the above described third embodiment is a low profile device in comparison to the other clamp means 46, 46A and 96 disclosed herein. This low profile configuration makes the clamp means 118 ideally suited for use in installation where limited space is provided such as in floor-ceiling structures of multi-story buildings and the like.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A system for adjustably mounting a branch pipeline of a sprinkler system to structural elements above a ceiling, said branch pipeline including a horizontal pipe having a distal end with a vertical pipe depending therefrom into a position proximate an opening formed in the ceiling and having a sprinkler head on the lower end of the vertical pipe, said system comprising:

(a) anchor means for fixed attachment to ta structural element above the ceiling and to the horizontal pipe of the branch pipeline; and (b) clamp means for fixed attachment to a structural element above the ceiling and for engaging the vertical pipe of the branch pipeline, said clamp means being operable in response to an operating force applied thereto in a direction parallel to the axis of the vertical pipe between a pipe gripping position wherein the vertical pipe and the sprinkler head are held immobile and a pipe releasing portion wherein the vertical pipe and the sprinkler head are vertically adjustable, said clamp means comprising:

(i) a spring band of circular configuration through which the vertical pipe passes when said clamp is disposed for engaging the vertical pipe, said circular band having adjacent ends which are normally spaced apart with respect to each other to provide the pipe releasing position of said clamp means;

(ii) a mounting flange mounted on said spring band at a location diametrically opposed to the adjacent ends thereof for fixed attachment to a structural element above the ceiling;

(iii) a first ear extending integrally from one of the adjacent ends of said spring band;

(iv) a second ear extending integrally from the other one of the adjacent ends of said spring band, said second ear having a flange which extends therefrom toward said first ear in underlaying engagement therewith;

(v) fastener means carried on the flange of said second ear and having a threaded shank which extends upwardly between said first and second ears and having a depending head means to which the operating force is applicable for rotation of said fastener means; and (vi) draw means in overlaying straddling engagement with said first and second ears and threadingly carried on the shank of said fastener means for movement between an elevated position wherein said ears are in their normally spaced apart position and a downwardly disposed position which pulls said first and second ears toward each other to circumferentially compress said spring band to provide the pipe gripping position of said clamp means.

2. A system as claimed in claim 1 wherein said draw means is of substantially U-shaped configuration and comprises:

(a) a bight portion having opposite ends;

(b) nut means on said bight portion and defining an internally threaded bore which is in threaded engagement with the threaded shank of said fastener means; and (c) a pair of arms which depend from different ones of the opposite ends of said bight portion at a diverging angle with respect to each other.

3. A system as claimed in claim 2 wherein said pair of arms of said draw means are configured as frusto-conical segments.

4. A system as claimed in claim 3 wherein said first and second ears are configured as frusto-conical segments that are nestingly disposed between said pair of arms of said draw means.

5. A system as claimed in claim 1 wherein said spring band is coated with a dielectric material.

* * * * *